US006552439B2

(12) United States Patent
Dunsworth et al.

(10) Patent No.: US 6,552,439 B2
(45) Date of Patent: Apr. 22, 2003

(54) METHOD AND APPARATUS FOR CONTROLLING ENGINE OVERSPEED DUE TO LUBE OIL INGESTION

(75) Inventors: Vincent F. Dunsworth, Edinboro, PA (US); Brian E. Celidonia, Erie, PA (US); Bret D. Worden, Union City, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/154,581

(22) Filed: May 24, 2002

(65) Prior Publication Data

US 2002/0175521 A1 Nov. 28, 2002

Related U.S. Application Data

(62) Division of application No. 09/593,254, filed on Jun. 13, 2000, now Pat. No. 6,429,540.

(51) Int. Cl.[7] ..... F02D 41/14

(52) U.S. Cl. ..... 290/41; 290/40 A; 123/352

(58) Field of Search ..... 290/41, 40 R, 290/40 A, 40 B, 40 C; 123/352, 357, 339.1

(56) References Cited

U.S. PATENT DOCUMENTS

| | | | | | |
|---|---|---|---|---|---|
| 5,901,683 | A | * | 5/1999 | Patel | 123/352 |
| 6,286,480 | B1 | * | 9/2001 | Chen et al. | 123/380 |
| 6,325,050 | B1 | * | 12/2001 | Gallagher et al. | 123/478 |
| 6,359,346 | B1 | * | 3/2002 | Kumar | 290/40 A |
| 6,429,540 | B1 | * | 8/2002 | Dunsworth et al. | 290/40 A |
| 2001/0039936 | A1 | * | 11/2001 | Ichihara et al. | 123/299 |
| 2002/0107107 | A1 | * | 8/2002 | Ogawa et al. | 477/111 |
| 2002/0175521 | A1 | * | 11/2002 | Dunsworth et al. | 290/40 A |

* cited by examiner

*Primary Examiner*—Nicholas Ponomarenko
(74) *Attorney, Agent, or Firm*—Carl A. Rowold; John L. DaAngelis, Jr.; Beusse Brownlee Bowdoin & Wolter, P.A.

(57) ABSTRACT

An apparatus and method for limiting diesel engine overspeed conditions (and thereby prevent engine damage) caused by the ingestion of lubricating oil from the turbocharger, or other source, into the diesel engine cylinders. In response to the development of an overspeed condition, the dynamic brake grids are coupled to the output of the main alternator to absorb the excess energy caused by the overspeed condition. Alternatively, non-combustible gases can be injected into the combustion system to limit the overspeed condition.

3 Claims, 2 Drawing Sheets

METHOD AND APPARATUS FOR CONTROLLING ENGINE OVERSPEED DUE TO LUBE OIL INGESTION

This application is a Divisional of Ser. No. 09/593,254 filed on Jun. 13, 2000 now U.S. Pat. No. 6,429,540.

BACKGROUND OF THE INVENTION

The invention relates generally to controlling engine overspeeding on a diesel engine, and more specifically to controlling overspeed caused by the ingestion of lubricating oil.

Large self-propelled traction vehicles, such as locomotives, commonly use a diesel engine to drive an electrical generation system comprising generating means for supplying electric current to a plurality of direct current traction motors whose rotors are drivingly coupled through speed-reducing gearing to the respective axle-wheel sets of the vehicle. The generating means typically comprises a main 3-phase traction alternator whose rotor is mechanically coupled to the output shaft of the engine, typically a 16-cylinder turbo-charged diesel engine. When excitation current is supplied to field windings on the rotating rotor, alternating voltages are generated in the 3-phase stator windings of the alternator. These voltages are rectified and applied to the armature windings of the traction motors.

During the "motoring" or propulsion mode of operation, a locomotive diesel engine tends to deliver constant power from the traction alternator to the traction motors, depending on the throttle setting and ambient conditions, regardless of locomotive speed. For maximum performance, the electrical power output of the traction alternator must be suitably controlled so that the locomotive utilizes full engine power. For proper train handling, intermediate power output levels are provided to permit graduation from minimum to full output. But the traction alternator load on the engine must not exceed the power the engine can develop. Overloads can cause premature wear, engine stalling or "bogging," or other undesirable effects. Historically, locomotive control systems have been designed so that the operator can select the desired level of traction power, in discrete steps between zero and maximum, so that the traction alternator, driven by the engine, can supply the power demanded by the traction load and the auxiliary loads.

Engine horsepower is proportional to the product of the angular velocity of the crankshaft and the torque opposing such motion. For the purpose of varying and regulating the engine power, it is common practice to equip a locomotive engine with a speed regulating governor that adjusts the quantity of pressurized diesel fuel (i.e., fuel oil) injected into each of the engine cylinders so that the actual speed (in RPM) of the crankshaft corresponds to a desired speed. The desired speed is set, within permissible limits, by a manually operated lever or handle of a throttle that can be selectively moved in eight steps or "notches" between a low power position (N1) and a maximum power position (N8). The throttle handle is part of the control console located in the operator's cab of the locomotive. In addition to the eight conventional power notches, the handle has an "idle" position and a continuously variable braking position corresponding to 0–100% of full allowable dynamic braking.

The position of the throttle handle determines the engine speed setting of the associated governor. In a typical electronic fuel injection governor system, the output signal from a controller drives an individual fuel injection pump for each cylinder, allowing the controller to individually control start of fuel injection and duration of fuel injection for each cylinder. The governor compares the desired speed (as commanded by the throttle) with the actual speed of the engine, and it outputs signals to the controller to set fuel injection timing to minimize any deviation therebetween.

The notch call or throttle handle position defines the speed and load on the engine, as requested by the locomotive operator. In response, the main locomotive controller requests the delivery of the required number of volts and amps from the traction alternator to supply the load defined by the notch position. The locomotive controller also transmits a signal representing the speed demand to the electronic fuel injection controller. The electronic fuel injection controller is a speed governor that controls the amount of fuel injected into each engine cylinder to maintain the requested speed. The electronic fuel injection controller is not aware of the load demand by the operator through the setting of the throttle handle. The electronic fuel injection controller calculates the required amount of fuel needed to maintain the desired speed. This fuel quantity is converted to a current pulse duration within the electronic fuel injection controller through a series of look-up tables. The look-up tables map the current duration of fuel injection as a function of engine speed, fuel demand, and start of injection timing. The tables are empirically determined based on bench tests where the fuel delivery quantity is measured while varying engine speed, start of injection timing, and the duration of the current pulse. Obviously, this calibration is determined when the fuel is at a specific temperature and the fuel injection equipment that is essentially new and therefore operating at peak efficiency. Further, the table is generic in that one table is used for all engines in the same engine family. The current pulse as determined from the look-up tables is sent to the pump solenoids that control the injection of fuel into each cylinder. The leading edge of the pulse determine the start of fuel injection, and the pulse duration determines the duration during which fuel is injected into the cylinder.

For each of its eight different speed settings, the engine is capable of developing a corresponding constant amount of horsepower (assuming maximum output torque). When the throttle notch 8 is selected, maximum speed (e.g., 1,050 rpm) and maximum rated gross horsepower (e.g., 4,500) are realized. Under normal conditions, the engine power at each notch equals the power demanded by the electric propulsion system, which is supplied by the engine-driven traction alternator, plus power consumed by certain electrically and mechanically driven auxiliary equipment.

The output power (KVA) of the traction alternator is proportional to the product of the rms magnitude of the generated voltage and load current. The voltage magnitude varies with the rotational speed of the engine, and is also a function of the excitation current magnitude supplied to the alternator field windings. For the purpose of accurately controlling and regulating the amount of power supplied to the electric load circuit, it is common practice to adjust the field strength of the traction alternator to compensate for load changes (traction motor loading and/or auxiliary loading) and minimize the error between actual and desired KVA. The desired power depends on the specific speed setting of the engine. Such excitation control establishes a balanced steady-state condition, resulting in a substantially constant, optimum electrical power output for each position of the throttle handle.

The full load fuel value represents the amount of fuel injected into each cylinder to produce combustion at full engine load. Diesel engines of different sizes have different full load fuel values. Of course, at less than full load, the quantity of fuel injected into each cylinder is lower. In the prior art, mechanically operated fuel injection pumps are controlled by engine rotation for injecting the fuel through a nozzle into the combustion chamber. The pump is manually controllable to avoid injecting excessive fuel values into the cylinder by the position of a set screw, which can be adjusted to decrease or increase the amount of fuel injected, up to a fuel value limit.

Today's modem diesel engine locomotives may also be equipped with a turbocharger driven by cylinder exhaust for providing compressed air to ignition cylinders. The exhaust gases drive the turbocharger to compress the intake air, which is then ported to the individual engine cylinders. Because the intake air is now compressed, the engine operates at a higher fuel efficiency. The turbocharger shaft is lubricated with engine oil. In one scenario, if the oil seal malfunctions, the lube oil leaks into the turbocharger body and is ingested into the cylinders along with the compressed air. This is not the only means by which lubricating oil may enter the cylinders, as is known in the art. The lubricating oil will ignite in the cylinders just as the fuel ignites. The ignition of the lubricating oil, in addition to the fuel value injected into the cylinder, can cause engine overspeeding, to the point where the engine is rotating at a speed in excess of its design limits. For the most serious cases of oil ingestion, catastrophic damage to the engine and the attached alternator, can occur. Further, since the fuel source is no longer under control, the locomotive operator has no means by which to stop the engine.

BRIEF SUMMARY OF THE INVENTION

The above-mentioned undesirable effects associated with diesel engine overspeed conditions due to lubricating oil ingestion can be mitigated by the present invention, which relates to a novel and unobvious apparatus for controlling the engine during lubrication and oil ingestion by loading the engine main alternator using the dynamic braking grids. That is, the energy from the alternator, as driven by the diesel engine, is dumped into the dynamic brake grids. As a result, the engine slows down, notwithstanding that the amount of fuel provided to each cylinder and the amount of lube oil ingested in each cylinder remains unchanged. Advantageously, this invention is operative in any situation where the engine overspeed; whether due to the ingestion of fuel oil or the injection of excessive quantities of fuel into the cylinders.

BRIEF DESCRIPTION OF THE DRAWINGS

The present invention can be more easily understood and the further advantages and uses thereof more readily apparent, when considered in view of the description of the preferred embodiments and the following figures in which.

DETAILED DESCRIPTION OF THE PREFERRED EMBODIMENTS

Figure 1:
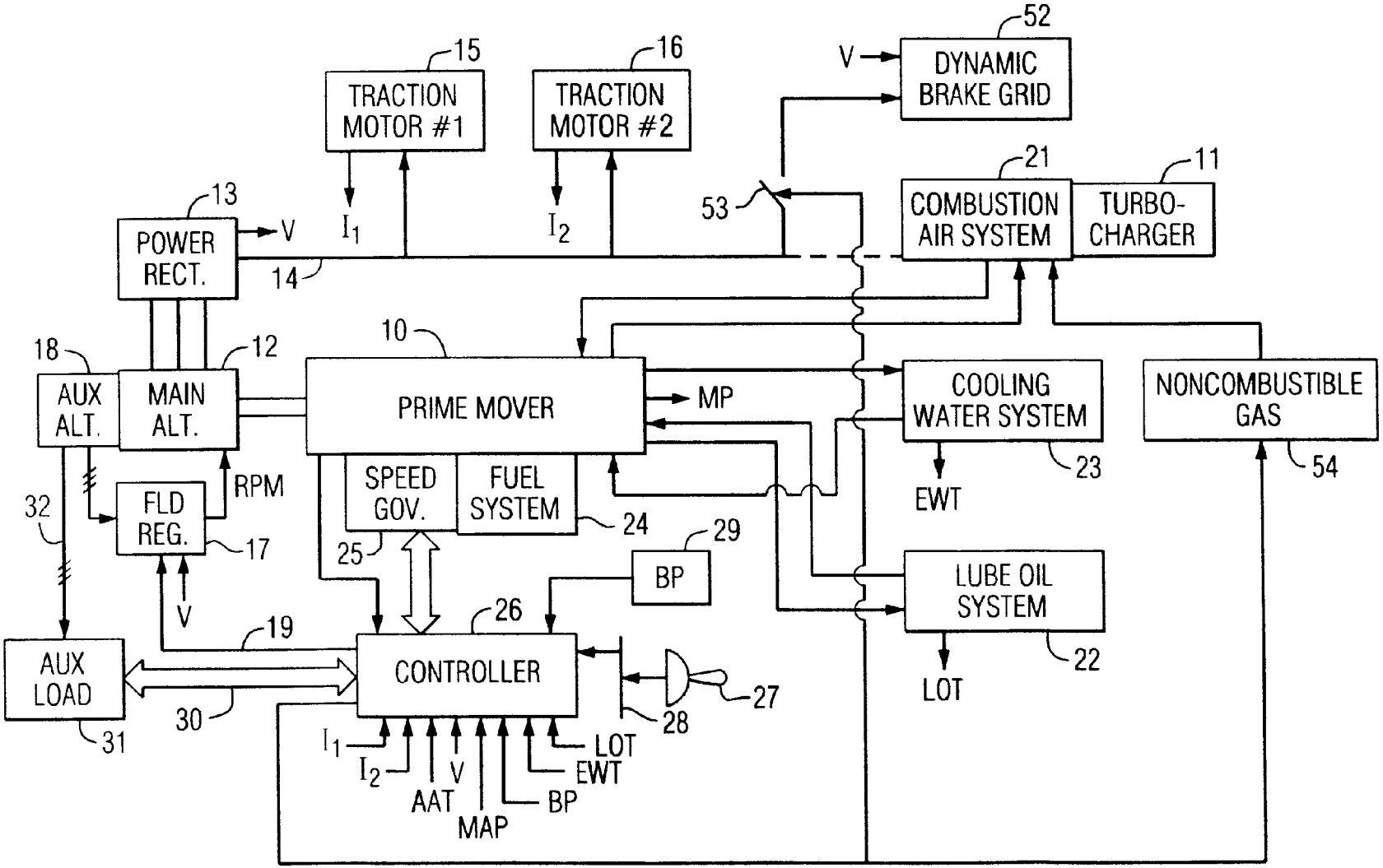
FIG. 1 illustrates the basic components of a diesel engine locomotive.

Before describing in detail the particular scheme for overcoming the problems associated with lube oil ingestion in accordance with the present invention, it should be observed that the present invention resides primarily in a novel combination of processing steps and hardware related to a method and apparatus for controlling the engine during lube oil ingestion. Accordingly, these processing steps and hardware components have been represented by conventional processes and elements in the drawings, showing only those specific details that are pertinent to the present invention so as not to obscure the disclosure with structural details that will be readily apparent to those skilled in the art having the benefit of the description herein.

Referring now to FIG. 1, there is shown a simplified functional block diagram of a locomotive propulsion system 8 including a variable speed prime mover or engine 10 mechanically coupled to drive a three-phase alternating current (AC) synchronous generator 12, also referred to as a main traction alternator 12. The three-phase voltages generated by the alternator 12 are applied to AC input terminals of at least one three-phase, bi-directional uncontrolled power rectifier bridge 13. In the illustrated system, the locomotive utilizes DC traction motors 15 and 16 for driving the wheels of the locomotive. In such a case, the rectified electric power output of the power rectifier bridge 13 is supplied via a DC bus 14 to the parallel connected armature windings of the traction motors 15 and 16. While only two motors, 15 and 16 are shown, in practice, a traction motor is supplied for each axle of a locomotive and there are typically two to three axles per truck with two trucks per locomotive, so that a conventional locomotive may have from four to six traction motors. If the traction motors are AC rather than DC motors, a controlled inverter (not shown) is interposed on the DC bus 14 to supply variable frequency power to the AC motors.

The prime mover 10 is a thermal or internal combustion engine and is typically a high horsepower, turbocharged, four stroke, 16 cylinder diesel engine. The turbocharger 11 provides compressed air to each of the diesel engine cylinders, which improves the fuel efficiency of the diesel engine. The turbocharger 11 is lubricated by engine lubricating oil. In the event one or more of the shaft lubricating seals malfunction, lubricating oil seeps into the turbocharger body and is ingested into the engine cylinders along with the compressed air. The deleterious effects associated with this phenomena and the technique of the present invention for overcoming these effects, will be discussed further herein below.

The prime mover 10 has a number of ancillary systems that are represented by the labeled blocks in FIG. 1. A combustion air system 21 conventionally includes the engine exhaust gas driven turbocharger for compressing air in the combustion air intake manifold of the engine, as discussed above. A lube oil system 22 conventionally includes an engine crankshaft driven pump and associated piping for supplying suitable lubricating oil to the various moving parts of the engine, including the turbocharger. A cooling water system 23 conventionally includes a pump for circulating relatively cool water from a plurality of air cooled heat exchangers or radiators to a lube oil cooler and to the cylinder liners of the engine for absorbing heat rejected during the combustion process, cooling water is also supplied to intercoolers through which the combustion air passes after being compressed by the turbocharger. Still further, the locomotive propulsion system 8 includes a fuel system 24 comprising a fuel tank, fuel pumps and nozzles for injecting fuel oil into the respective power cylinders, which are arranged in two rows or banks on opposite sides of the prime mover 10. Tappet rods cooperate with fuel cams on a pair of camshafts for actuating the respective fuel injectors at the proper times during each full turn of the engine camshaft. The engine speed governor 25 controls start of and duration of fuel flow into the cylinder each time the associated injector is actuated by controlling each fuel pump solenoid, and hence the quantity of fuel that is being supplied to the engine. While shown separately, the electronic speed governor 25 is actually incorporated in the controller 26. The engine speed governor 25 regulates engine speed by automatically controlling fuel flow within predetermined fuel value limits in a direction and by an amount that minimizes any difference between actual and desired speeds of the engine crankshaft. The desired speed is set by a variable speed control signal received from a controller 26, which signal is herein called a speed command signal or speed call signal.

In the normal motoring or propulsion mode of operation, the value of the engine speed call signal provided by the controller 26 is determined by the position of a handle 27 of a manually operated throttle to which the controller 26 is coupled. A locomotive throttle conventionally has eight power positions or notches (N1–N8), plus an idle position and a continuously variable braking position. N1 corresponds to the minimum desired engine speed or power, while N8 corresponds to maximum speed and full power. In idle position, the locomotive produces no tractive power, but the engine still runs to produce power for auxiliary function such as blower fans. In braking mode, the engine runs at sufficient speed and horsepower to provide cooling air to components in addition to running auxiliary functions. In a consist of two or more locomotives, only the lead unit is usually attended and the controller on board each trailing unit receives, over a train line 28, a signal that indicates the throttle position selected by the operator in the lead unit.

For each throttle position there is a corresponding desired load. The controller 26 is arranged to translate the throttle notch information into a control signal of appropriate magnitude on the input line 19 of the alternator field regulator 17, whereby the traction power is regulated to match the called-for power, so long as the alternator output voltage and load current are both within predetermined limits. For this purpose, it is necessary to supply the controller 26 with information about various operating conditions and parameters of the propulsion system, including the prime mover 10 and its support systems. More particularly, the controller 26 typically receives voltage and current feedback signals representative of the power supplied to the traction motors and a load control signal issued by the engine speed governor 25 if the engine cannot develop the power demanded and still maintain the called-for speed. The controller 26 also receives an engine speed signal (in RPM) indicating the rotational speed of the engine crankshaft and ambient air pressure signal (BP) from a barometric pressure sensor 29, an intake manifold air pressure signal (MAP) from a pressure sensor associated with an air intake manifold at the engine, an oil temperature signal (LOT) from a temperature sensor on the hot oil side of the lube oil cooler, a water temperature signal (EWT) from a temperature sensor in a hot water section of the cooling water system 23 and an ambient air temperature signal (AAT) from an appropriate air temperature sensor. The controller uses the signal EWT to control radiator fan motors that control the flow of air across the heat exchange tubes of the radiators to maintain a relatively constant engine operating temperature over the load range of the engine and with wide variations in ambient temperature.

The above listing is representative of the signals that are applied to the controller 26 to enable the controller 26 to properly set the fuel level to the prime mover 10 to regulate the power output of the engine to meet the requirements of the locomotive and any auxiliary equipment coupled to the locomotive. While each cylinder of the engine 10 has its own individually controllable fuel injector, typical operation of the engine 10 is to supply the same control signal from the controller 26 to each fuel injector such that the amount of fuel injected into each cylinder of the engine 10 is the same.

A dynamic brake grid 52 is also illustrated in FIG. 1. The dynamic brake grid 52, in one embodiment, comprises a plurality of resistive or load elements for absorbing and dissipating electrical energy. The dynamic brake grid 52 is cooled by a shunt connected fan, not shown in FIG. 1. In the dynamic braking mode of operation, the dynamic brake grids 52 are shunted across terminals of the traction motors 15 and 16 while the motors, driven by the moving wheels of the locomotive, act as generators. The current generated by the traction motors 15 and 16 passes through the dynamic brake grid 52 where the resistive elements convert the current into heat, which is in turn dissipated by the cooling system.

A switch 53 is shown in FIG. 1 for connecting or disconnecting the dynamic brake grid 52 from the DC bus 14. In normal locomotive operation, the switch 53 is open. When it is desired to use the dynamic brakes, the switch 53 is closed so that the electrical energy generated by the traction motors in the dynamic braking operational mode is dissipated in the dynamic brake grid 52. In accord with the present invention, the switch 53 can be closed under control of the controller 26 executing the process of FIGS. 2 and 3 to load the engine 10, specifically to load the DC bus 14, thereby limiting engine speed and preventing an engine overspeed condition. In lieu of a mechanical switch, the switch 53 can also be implemented using a transistor operative as a switch, as is known by those skilled in the art.

Figure 2:
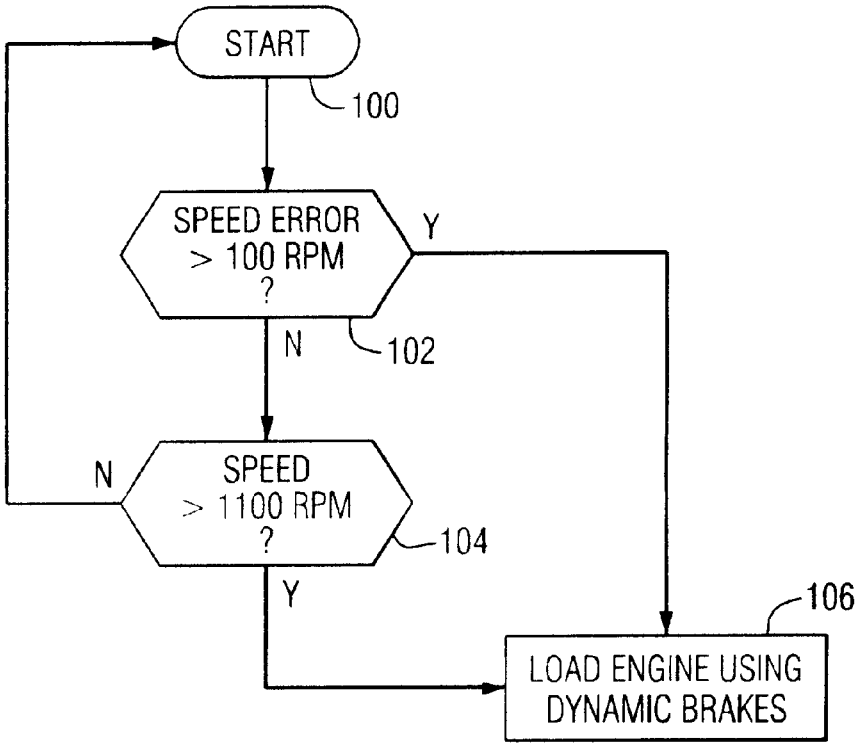
FIGS. 2 and 3 illustrate flowcharts associated with the present invention.

Closing of the switch 53 is controlled as follows. Recall as discussed above, that the engine speed governor 25 regulates engine speed by automatically controlling fuel flow to minimize differences between the actual and desired speeds of the engine crank shaft. FIG. 2 illustrates a flow chart for making this determination. The process set forth in FIG. 2 (and the process set forth in FIG. 3) can be executed by a microprocessor and its associated components within the controller 26. Alternatively, an independent microprocessor with assorted input and output devices and memory storage, can be used to execute the processes set forth in FIGS. 2 and 3. Processing begins at a start step 100 and proceeds to a decision step 102 where a determination is made whether the speed error is greater than 100 RPM's (for example). An affirmative value from this decision step indicates that the electronic fuel controller governor 25 may not be operating properly. Under normal fuel control conditions, the engine speed governor 25 controls fuel injection so that the error between the desired speed and the actual speed is far less than 100 RPM's. When the speed error is greater than 100 RPM's, this is an indication that the engine speed governor 25 has lost its ability to control the engine speed, for example due to the ingestion and ignition of lubricating oil from the turbocharger. Other engine overspeed causes include: controller failure, high pressure fuel pump failure, or any mechanical failure that causes fuel or oil to enter the intake manifold or cylinders. For example, a cylinder head failure can cause a diesel locomotive to run away by placing oil directly into the intake manifold. Note that these failures also can be detected and controlled in accord with the present invention. As an additional protective feature, a decision step 104 determines whether the engine speed is in excess of some maximum design value. In one specific locomotive, the diesel engine is designed to operate at a maximum of 1050 RPM. Thus, the decision step 104 determines whether the engine speed is in excess of 1100 RPM. If the result of the decision step 104 (or the decision step 102) is affirmative, processing moves to a step 106 where the engine is loaded using the dynamic brakes, i.e., the switch 53 is closed under control of the controller 26. Further, under control of the controller 26, the traction motors are isolated from the DC bus 14 under control of power transistors not shown in FIG. 1. Of course, as discussed above, if the locomotive operator realizes there is an engine overspeed condition, he can lower the notch number and in this way lower the fuel quality injected into each cylinder as a means of controlling that overspeed condition. However, the operator will soon realize that this effort is futile because the engine is burning lubrication oil in addition to diesel fuel. It is possible, that regardless of the position in which the operator places the control handle, the engine can continue to overspeed simply due to the ingestion and ignition of the lubricating oil. Additionally, the shut down controls will not cause the engine to stop.

When the switch 53 is closed, the dynamic brake grids absorb the energy produced by the main alternator 12. As the dynamic brake grids absorb more energy, the load on the main alternator 12 declines and the main alternator 12 attempts to generate more energy and thus increases the load on the prime mover 10. In effect, the main alternator 12 is being used as a crude speed regulator to hold down the diesel engine speed and prevent it from developing an overspeed condition where serious damage can occur. However, the load placed on the engine by the main alternator 12 must be limited to ensure continued operation of the auxiliary alternator 18. This control process is discussed below in conjunction with FIG. 3. The auxiliary alternator 18 provides power to multiple auxiliary systems on the locomotive and it is critical that these systems continue to function.

The engine loading process is, in a sense, self regulating. Applying the dynamic brake grids 52 causes the output voltage from the main alternator 12 to drop, which places less load on the engine 10, at which point the engine speeds up and the alternator voltage increases. The increased energy is dissipated in the dynamic brake grids 52, causing the output voltage from the main alternator 12 to decrease and the engine load to also decrease. The cycle continues to repeat itself.

In lieu of a software based process for controlling the switch 53, the present invention can be carried out using a hardware comparator, which is well known in the art. A first input to the comparator is the actual engine speed and a second input thereto is the demanded engine speed. Signals representing both the actual engine speed and the demanded engine speed can be obtained from the speed governor 25. The hardware comparator utilizes an input reference value and determines when the difference between two engine speed values exceeds the reference value. When that reference value has been exceeded, the comparator generates a signal to close the switch 53. In the embodiment wherein non-combustible gases are input to the combustion air system 21, the comparator is made to control the non-combustible gas supply 54.

Figure 3:
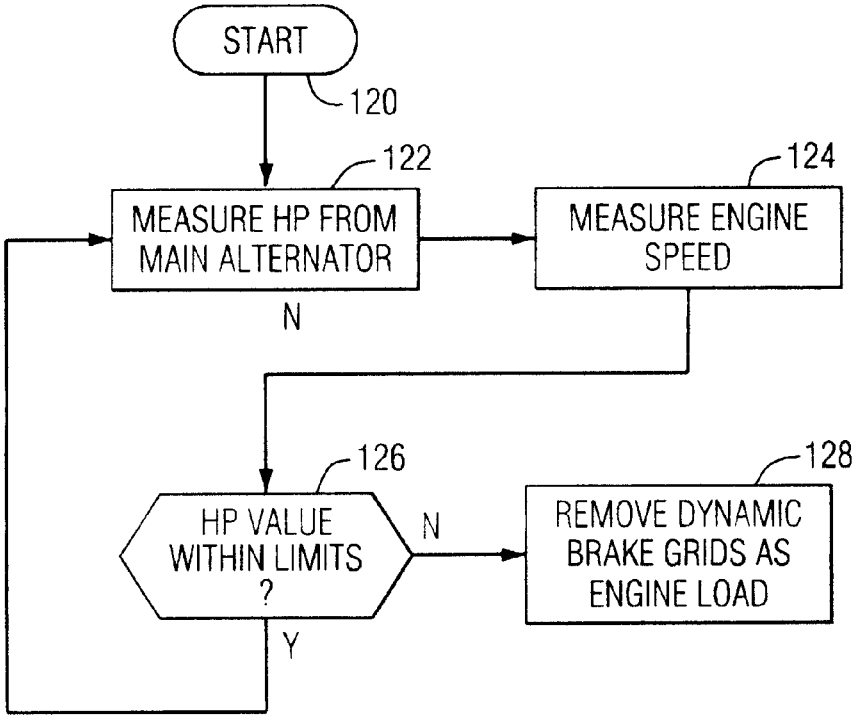

The flow chart of FIG. 3 is processed to ensure that the engine speed is sufficient to allow continued operation of the auxiliary alternator 18. It is critical to ensure the auxiliary alternator 18 continues to function. As can be seen from FIG. 1, the auxiliary alternator 18 provides an input to the field regulator 17 for the purpose of controlling the main alternator 12. It is necessary for the auxiliary alternator 18 to continue running so that control over the main alternator 12 can be maintained and thus the engine speed can be controlled in accord with the present invention. The objective of the FIG. 3 process is to ensure that the dynamic brake grid 52 does not excessively load the prime mover 10 to the point where the auxiliary alternator 18 stops producing energy. Processing begins at a step 120 and continues to a step 122 where the horsepower output from the main alternator 12 is measured. At a step 124, the engine speed is measured. At a decision step 126, a determination is made whether the horsepower value is within limits for the engine speed. In one embodiment, the horsepower reference is zero at an engine speed of 400 RPM and full horsepower (typically 4400 or 6000) at an engine speed of 800 RPM. The reference for engine speeds between 400 and 800 can be determined by linear interpolation between these two end points. If the horsepower beyond the limit for the engine speed, then it is apparent that the main alternator is overloading the engine. Processing moves to a step 128 where the dynamic brake grids 52 are disconnected by opening the switch 53.

Returning to FIG. 1, there is an alternate scheme for limiting engine overspeed situations. A non-combustible gas supply 54 is available for supplying non-combustible gas to the combustion air system 21. Once the non-combustible gas is injected into the engine cylinders, the combustion process would effectively stop. The control mechanism for supplying the non-combustible gas would be similar to the control mechanism for the application of the dynamic brake grids 52, that is, the processes set forth in FIGS. 2 and 3 as executed by the controller 26. Carbon dioxide, argon, and haylon are potential non-combustible gases to be used in this embodiment of the present invention. In yet another embodiment of the present invention, a shut-off or guillotine valve can be placed in the air line (not shown in FIG. 1). Using a control system similar to that employed for controlling the application of the dynamic brake grids 52, the guillotine valve can be closed to completely shut off the air intake manifold.

While the invention has been described with reference to a preferred embodiment, it will be understood by those skilled in the art that various changes may be made and equivalent elements may be substituted for elements thereof without departing from the scope of the present invention. In addition, modifications may be made to adapt a particular situation more material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for controlling operation of a railroad locomotive, wherein the locomotive comprises a throttle for setting an engine speed demand, the engine having a plurality of cylinders wherein combustion occurs due to injection of fuel into each cylinder under control of a fuel controller in response to the difference between the actual engine speed and the demanded engine speed, wherein the engine is drivingly coupled to a traction alternator for supplying electrical energy to traction motors to move the locomotive, and wherein the locomotive includes passive loads to which the electrical energy generated by the traction alternator can be selectably coupled, said method comprising:

(a) determining that the actual engine speed is greater than the demanded engine speed by a predetermined reference value; and (b) injecting a non-combustible gas into the cylinders in response to step (a).

2. An apparatus for controlling operation of a railroad locomotive, wherein the locomotive comprises a throttle for setting an engine speed demand, the engine having a plurality of cylinders wherein combustion occurs due to injection of fuel into each cylinder under control of a fuel controller in response to the difference between the actual engine speed and the demanded engine speed, wherein the engine is drivingly coupled to a traction alternator for supplying electrical energy to traction motors to move the locomotive, and wherein the locomotive includes passive loads to which the electrical energy generated by the traction alternator can be selectably coupled, said apparatus comprising:

means responsive to the actual engine speed and the engine speed demand for determining when the actual engine speed is greater than the demanded engine speed by a predetermined reference value; and means for injecting a non-combustible gas into the cylinders in response to the means for determining.

3. An apparatus for controlling operation of a railroad locomotive, wherein the locomotive comprises a throttle for setting an engine speed demand, the engine having a plurality of cylinders wherein combustion occurs due to injection of fuel into each cylinder under control of a fuel controller in response to the difference between the actual engine speed and the demanded engine speed, wherein the engine is drivingly coupled to a traction alternator for supplying electrical energy to traction motors to move the locomotive, and wherein the locomotive includes passive loads to which the electrical energy generated by the traction alternator can be selectably coupled, said apparatus comprising:

a comparator responsive to the actual engine speed and the engine speed demand for determining when the actual engine speed is greater than the demanded engine speed by a predetermined reference value; and an injector for injecting a non-combustible gas into the cylinders in response to said comparator.

* * * * *